US007163062B2

(12) United States Patent
Sele

(10) Patent No.: US 7,163,062 B2
(45) Date of Patent: Jan. 16, 2007

(54) RISER

(75) Inventor: Arne Sele, Hosle (NO)

(73) Assignee: Aker Riser Systems AS, Osto (NO)

( * ) Notice: Subject to any disclaimer, the term of this patent is extended or adjusted under 35 U.S.C. 154(b) by 0 days.

(21) Appl. No.: 10/857,362

(22) Filed: May 28, 2004

(65) Prior Publication Data

US 2005/0006101 A1 Jan. 13, 2005

(30) Foreign Application Priority Data

Jun. 2, 2003 (NO) ..... 20032484

(51) Int. Cl.
*E21B 29/12* (2006.01)

(52) U.S. Cl. ..... 166/367; 166/355; 405/224.2

(58) Field of Classification Search ..... 166/346, 166/355, 345, 350, 351, 352, 368, 367; 405/224.2, 405/224.3, 224.4

See application file for complete search history.

(56) References Cited

U.S. PATENT DOCUMENTS 3,339,512 A * 9/1967 Siegel ..... 114/257
3,359,741 A * 12/1967 Nelson ..... 405/200
3,461,916 A * 8/1969 Ledgerwood, Jr. ..... 138/120
3,841,357 A * 10/1974 Heijst ..... 138/120
3,913,668 A * 10/1975 Todd et al. ..... 166/359
4,067,202 A * 1/1978 Reed ..... 405/224.2
4,105,068 A * 8/1978 Tam ..... 166/355
4,279,543 A * 7/1981 Remery ..... 405/224.3
4,690,181 A * 9/1987 Carrio ..... 141/388
4,730,677 A * 3/1988 Pearce et al. ..... 166/345
4,735,267 A * 4/1988 Stevens ..... 166/345
5,527,130 A * 6/1996 Webb ..... 405/52
5,553,976 A * 9/1996 Korsgaard ..... 405/195.1
6,527,053 B1 * 3/2003 Friisk ..... 166/346
6,619,887 B1 * 9/2003 Szewczyk et al. ..... 405/211
6,837,311 B1 * 1/2005 Sele et al. ..... 166/353

* cited by examiner

*Primary Examiner*—Thomas A Beach
(74) *Attorney, Agent, or Firm*—Townsend and Townsend and Crew LLP

(57) ABSTRACT

A riser for conveying fluids from a subsea location to a surface vessel comprises an upper section which is located in a confining conduit, said upper section being allowed to deform elastically into a helical configuration against the inside of the confining conduit when subjected to axial compression. The riser further comprises a main section extending below the confining conduit to said subsea location. The riser also comprises a buoyancy arrangement which keeps the main section in tension. This arrangement allows the Christmas tree to be supported directly on the deck of the surface structure and allows the surface structure to support the weight of the tree as well as the tubing which is hung off from the tree.

13 Claims, 4 Drawing Sheets

RISER

BACKGROUND OF THE INVENTION

1. Field of the Invention

The present invention relates generally to applying top tension to a riser extending from a subsea location to a surface vessel used in offshore production of hydrocarbons, the riser accommodating relative movement between the seabed and surface vessel.

2. Description of Related Art

The valve assembly, often known as Christmas tree, which is used to control wells producing hydrocarbons offshore, may either be placed on the seabed or on a surface structure. When the Christmas tree is to be placed at a surface vessel, a production riser is installed between the surface structure and the wellhead. The hydrocarbons are produced through a tubing which is run through, and hung off from the Christmas tree, the production riser and the casing assembly of the well, penetrating into the strata from which hydrocarbons are produced. The production riser acts as a second fluid barrier in the event of leakage from the tubing or the wellhead. In order to run tubing and perform other operations in the well, the risers need to be straight and near vertical. Substantial top tension needs to be applied to maintain straightness and to prevent fatigue due to excessive dynamic response due to the action of waves and current.

This type of risers will buckle and be destroyed if they are subjected to compression. They must therefore be tensioned over their entire length. This tension may be applied with hydraulic or pneumatic cylinders, buoyancy tanks or counterweights. Current practice is to connect the wellheads to the processing equipment on deck with flexible jumpers.

U.S. Pat. No. 5,553,976 proposes an ocean riser assembly including a fluid conveying pipe extending between the seabed and the surface and being formed into a helical configuration or undulating configuration over its entire length, the pipe being attached at spaced intervals to flexible and elastic tension members extending in the longitudinal direction of the riser. Such an arrangement is difficult to install and needs additional buoyancy along its entire length to maintain its structural integrity, such buoyancy adding substantially to the cost of the riser assembly.

WO 01/14687, which belongs to the Assignee of the present application, shows a hybrid riser configuration for use in very deep waters. The hybrid riser comprises a tower structure containing a plurality of steel riser pipes extending vertically from the seabed to a buoyancy tank located about 100 meters below the sea surface. Each riser pipe is confined in an aluminium guide conduit, which acts as a means for mooring the buoyancy tank and which also permits the riser pipe to buckle in Euler deformation into a spiral along the inside of the aluminium guide conduit. This arrangement permits the use of relatively thin-walled steel riser pipes. However, these pipes have to be terminated in the buoyancy tank, where they are connected to so-called jumpers, which are flexible pipelines which lead to the surface vessel and have sufficient slack to permit excursions by the surface vessel. These jumpers hinder the running of tubing and other operations in the well.

Both WO 01/14687 and U.S. Pat. No. 5,553,976 are hereby incorporated by reference.

BRIEF SUMMARY OF THE INVENTION

The purpose of the present invention is to accommodate the relative motion between the riser and the surface structure in a simple and effective way which is applicable for high temperature, high wellhead pressure and large relative motions.

This is obtained by a riser for conveying fluids from a subsea location to a surface vessel, the riser comprising an upper section which is located in a confining conduit, said upper section being allowed to deform elastically into a helical configuration against the inside of the confining conduit when subjected to axial compression, the riser further comprising a main section extending below the confining conduit for connection to said subsea location. The riser also comprises a buoyancy arrangement for keeping the main section in tension.

The described arrangement allows the Christmas tree to be supported directly on the deck of the surface structure. This allows the surface structure to support the weight of the tree as well as the tubing which is hung off from the tree. This in turn substantially reduces the load which must be supported by the buoyancy tanks and greatly reduces their size.

These and other features and advantages of the riser according to the present invention are described below in connection with the exemplifying embodiments shown in the drawings.

DETAILED DESCRIPTION OF THE INVENTION

The two embodiments shown in FIG. 1*a–b* and FIG. 2*a–b*, respectively, both show a surface vessel 8 in the form of a semi-submergible platform structure which is provided with a valve assembly 7 (Christmas tree). A riser extends from the valve assembly 7 down to the seabed (not shown). The riser has an upper section 3 which extends inside a confining conduit 1, which in the FIG. 1*a–b* embodiment is fixedly attached to the surface vessel 8. In the FIG. 2*a–b* embodiment it is attached to the riser itself. The latter embodiment is therefore referred to as an integral configuration, and the FIG. 1*a–b* embodiment is conversely referred to as a non-integral configuration.

Figure 1A:
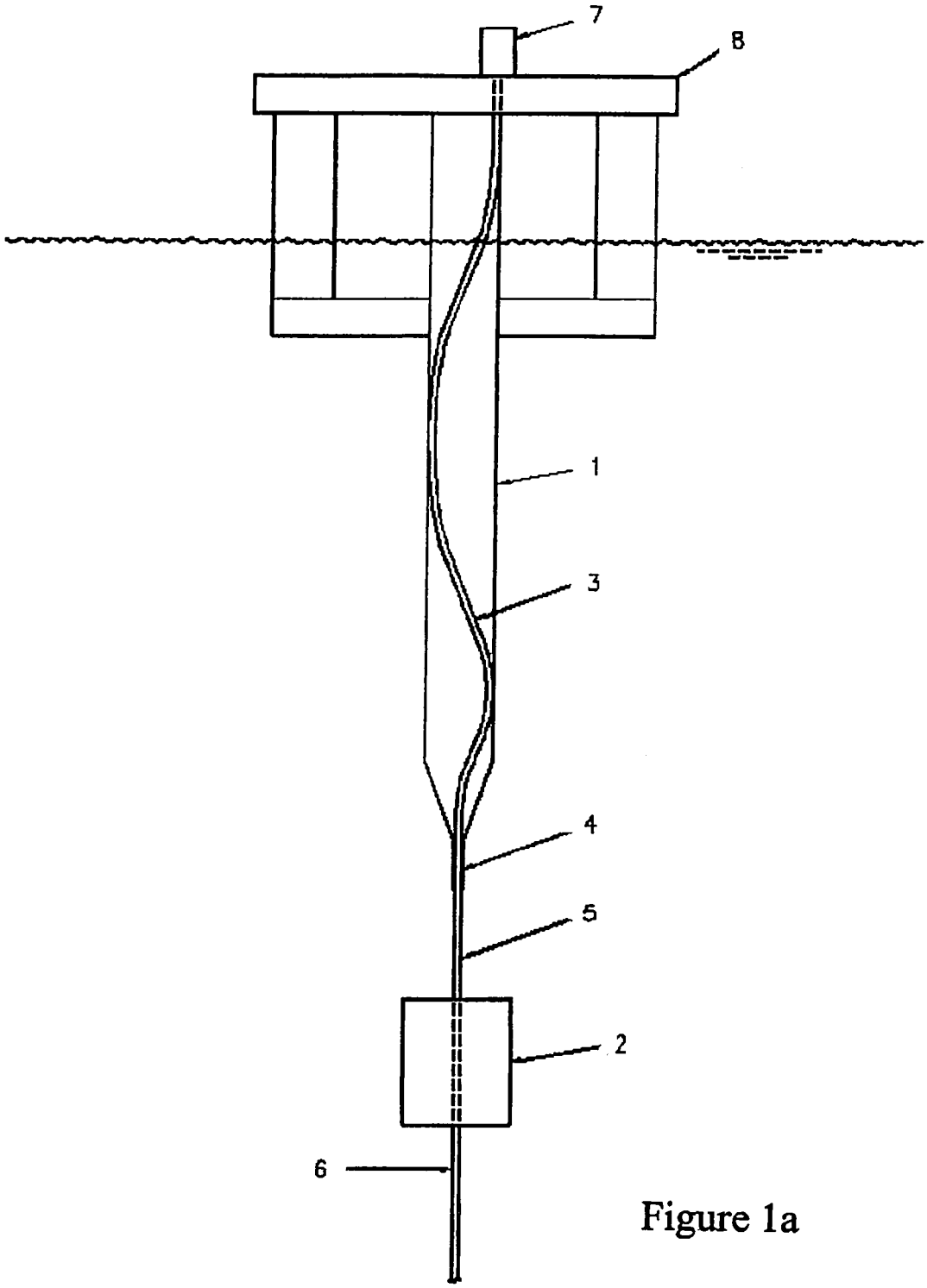
FIG. 1*a* shows a schematic side elevation, partly in section, of a first embodiment of the riser according to the present invention in neutral position.
Figure 1B:
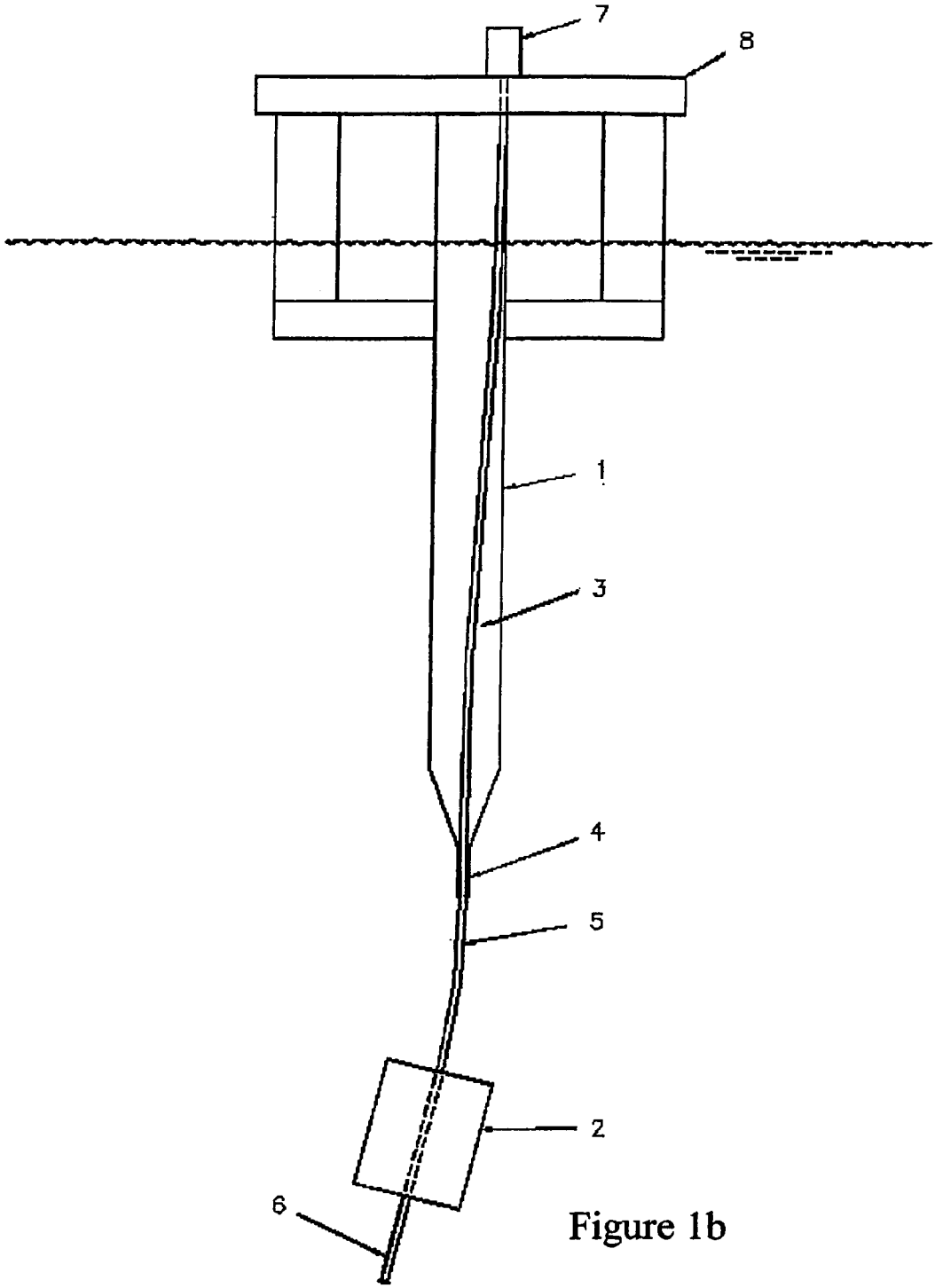
FIG. 1*b* shows schematically the riser of FIG. 1*a* in a position displaced laterally from the neutral position.

Below the confining conduit 1 the upper riser section 3 is connected to the main section 6 of the riser, which extends down to a subsea location, e.g. a wellhead or other equipment on the seabed, where it is anchored. The main section 6 of the riser is kept in tension by a buoyancy arrangement 2, which in the FIG. 1*a–b* is schematically shown as a tank attached to the upper part of the main riser section 6. In the FIG. 2*a–b* embodiment the buoyancy arrangement comprises an elongated tank arranged concentrically within the confining conduit 1, thus forming an annular space inside the confining conduit 1 wherein the upper section 3 of the riser may attain its more or less helical configuration.

In the FIG. 1*a–b* embodiment the lower end of the confining conduit is provided with a guide pipe 4 for a portion 5 of the upper section 3 which connects to the main section 5 of the riser. The portion 5 has a higher stiffness than the rest of the upper section to ensure that it will not buckle under the maximum compressive load to which it will be subjected. Furthermore, the guide pipe 4 has sufficient strength and stiffness to restrain the unsupported length of the riser portion 5 from buckling.

Figure 2A:
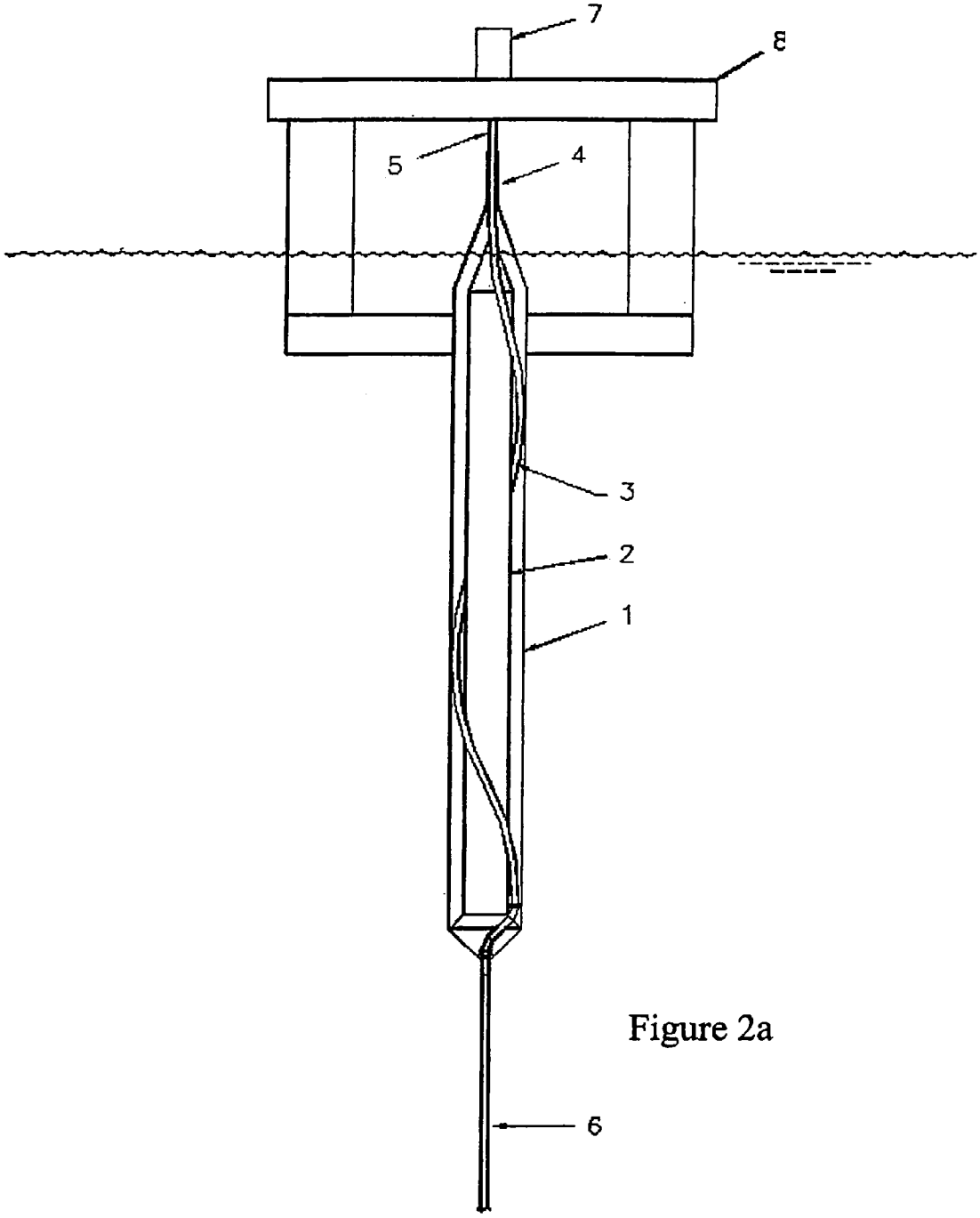
FIG. 2*a* is a schematic side elevation view, partly in section, of a second embodiment of a riser according to the present invention in neutral position.
Figure 2B:
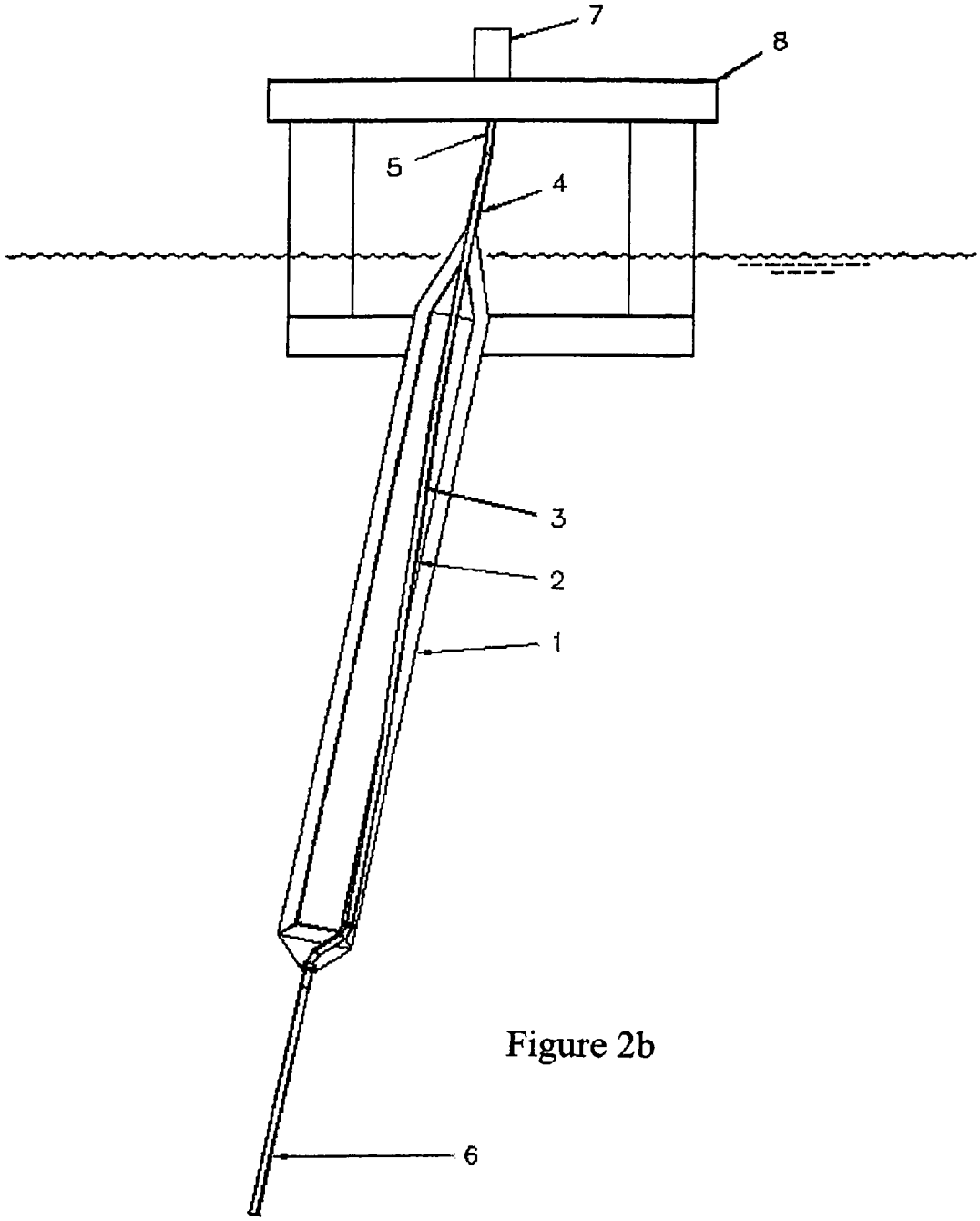
FIG. 2*b* shows schematically the riser of FIG. 2*b* in a position displaced laterally from the neutral position.

In the FIG. 2*a–b* embodiment the guide pipe 4 is located at the upper end of the confining conduit 1, and the stiffer portion 5 of the riser is attached directly to the surface vessel 8.

FIGS. 1*a* and 2*a* show the platform 8 in the neutral position experienced when no environmental actions are applied. In this situation, the buoyancy tank 2 is at its highest elevation and the upper section of the riser 3 experiences its maximum compression and smallest pitch.

FIGS. 1*b* and 2*b* show risers in the extreme position due to extreme environmental actions. In this situation the buoyancy tank 2 is drawn down to maximum submergence and the upper section of the riser 3 experiences maximum extension and is nearly straight.

The upper section of the riser 3 may be initially straight before installation. When subjected to compressive load it will, due to the confining conduit 1, deform into a helix. As compression is increased the pitch of the helix is reduced and the compressive force increases, accommodating the displacement of the surface structure. The upper section 3 may also be helically pre-formed during installation.

This arrangement accommodates having the valve assembly 7 for controlling the well rigidly fixed to the deck of the floating structure. Furthermore, the arrangement may advantageously replace some common motion compensation systems in other applications.

It will be understood that the present invention is not limited to the exemplifying embodiments shown in the drawings and discussed above, but may be varied and modified by the skilled person within the scope of the invention defined by the appended claims.

The invention claimed is:

1. A riser for conveying fluids from a subsea location to a surface vessel, the riser comprising a main section extending from said subsea location to a buoyancy arrangement for keeping the main section in tension, the riser above said buoyancy arrangement comprising an upper section of variable length and connecting the main section to the surface vessel, a portion of said upper section being located in a confining conduit and allowed to deform elastically into a substantially helical configuration against an inside of the confining conduit when subjected to axial compression due to a decreasing distance between the buoyancy arrangement and the surface vessel.

2. A riser according to claim 1, wherein the confining conduit at one end comprises a guide arrangement through which a portion of the upper section is free to move as the confined part of the upper section changes in length due to varying axial forces.

3. A riser according to claim 2, wherein the guide arrangement is located at a lower end of the confining conduit, said portion of the upper section being connected to the main section.

4. A riser according to claim 3, wherein the buoyancy arrangement is located near a junction of said portion of the upper section and the main section.

5. A riser according to claim 2, wherein the guide arrangement is located at an upper end of the confining conduit, said portion of the upper section being connected to the surface vessel.

6. A riser according to claim 5, wherein at least part of the buoyancy arrangement is located coaxially inside the confining conduit, an annular space being formed therebetween in which the upper section may attain its helical configuration.

7. A riser according to claim 2, wherein the guide arrangement comprises a guide tube for restraining said portion of the upper section from buckling.

8. A riser according to claim 2, wherein said portion of the upper section has higher stiffness than a remainder of the upper section.

9. A riser according to claim 1, wherein the upper section is connected to a valve assembly on the floating vessel.

10. A riser according to claim 1, wherein the vessel is a semi-submersible platform structure.

11. A method for accommodating lateral excursions of a surface vessel engaged in the production of hydrocarbons from at least one well on the seabed, wherein the surface vessel is connected, directly or indirectly, to said at least one well by at least one riser as claimed in claim 1.

12. A riser for conveying fluids from a subsea location to a surface vessel, the riser comprising an upper section which is located in a confining conduit, said upper section being allowed to deform elastically into a substantially helical configuration against the inside of the confining conduit when subjected to axial compression, the riser further comprising a main section extending below the confining conduit for connection to said subsea location, and a buoyancy arrangement for keeping the main section in tension, wherein the confining conduit at one end comprises a guide arrangement through which a portion of the upper section is free to move as the confined part of the upper section changes in length due to varying axial forces, and wherein the guide arrangement is located at an upper end of the confining conduit, said portion of the upper section being connected to the surface vessel.

13. A riser for conveying fluids from a subsea location to a surface vessel, the riser comprising an upper section which is located in a confining conduit, said upper section being allowed to deform elastically into a substantially helical configuration against the inside of the confining conduit when subjected to axial compression, the riser further comprising a main section extending below the confining conduit for connection to said subsea location, and a buoyancy arrangement for keeping the main section in tension, wherein the confining conduit at one end comprises a guide arrangement through which a portion of the upper section is free to move as the confined part of the upper section changes in length due to varying axial forces, and wherein the guide arrangement comprises a guide tube for restraining said portion of the upper section from buckling.

* * * * *